US009704680B1

(12) United States Patent
Hedeen et al.

(10) Patent No.: US 9,704,680 B1
(45) Date of Patent: Jul. 11, 2017

(54) MAGNETIC SWITCH

(71) Applicant: Magnasphere Corporation, Waukesha, WI (US)

(72) Inventors: Joseph C. Hedeen, Menomonee, WI (US); Randall Woods, Sun Lakes, AZ (US); Larry Hedeen, Howe, IN (US)

(73) Assignee: Magnasphere Corporation, Waukesha, WI (US)

( * ) Notice: Subject to any disclaimer, the term of this patent is extended or adjusted under 35 U.S.C. 154(b) by 0 days.

(21) Appl. No.: 15/044,037

(22) Filed: Feb. 15, 2016

(51) Int. Cl.
*H01H 36/00* (2006.01)

(52) U.S. Cl.
CPC ..... *H01H 36/0073* (2013.01)

(58) Field of Classification Search
CPC ..... H01H 36/0046; H01H 36/00
USPC ..... 335/205–207; 340/547
See application file for complete search history.

(56) References Cited

U.S. PATENT DOCUMENTS 4,001,185 A * 1/1977 Mitsui ..... B60R 22/343 200/277
4,042,796 A * 8/1977 Zink ..... H01H 35/144 200/61.45 R
4,766,275 A * 8/1988 Hemmann ..... H01H 35/025 200/277
5,332,992 A 7/1994 Woods
5,530,428 A 6/1996 Woods
5,673,021 A 9/1997 Woods
5,880,659 A 3/1999 Woods
5,977,873 A * 11/1999 Woods ..... H01H 36/0073 335/205
6,087,936 A * 7/2000 Woods ..... G01H 11/06 340/429
6,506,987 B1 1/2003 Woods
6,603,378 B1 8/2003 Collins
6,803,845 B2 10/2004 Woods
7,023,308 B2 * 4/2006 Woods ..... H01H 36/00 335/205
RE39,731 E 7/2007 Woods
7,291,794 B2 * 11/2007 Woods ..... H01H 36/00 200/61.62
7,825,801 B2 11/2010 Woods
7,944,334 B2 5/2011 Woods
8,228,191 B2 7/2012 Woods
8,314,698 B2 11/2012 Woods
8,487,726 B2 * 7/2013 Woods ..... H01H 36/0046 335/205
8,648,720 B2 2/2014 Woods
2007/0035370 A1 * 2/2007 Habboosh ..... H01H 9/0207 335/205

FOREIGN PATENT DOCUMENTS

EP 2638555 A2 9/2013

* cited by examiner

*Primary Examiner* — Alexander Talpalatski
(74) *Attorney, Agent, or Firm* — Hovey Williams LLP

(57) ABSTRACT

An improved magnetic switch assembly (16) has a housing (24), a first electrode (40) positioned within the housing (24), a second electrode (42), and a magnetically movable component (48) located within the housing (24) and shiftable between a first position in simultaneous contact with electrodes (40, 42), and a second position out of such simultaneous contact. The electrode (40) has a radially enlarged contact section (44, 58) adjacent the free end thereof which prevents hangup or sticking of component (48) in the first position.

4 Claims, 1 Drawing Sheet

MAGNETIC SWITCH

BACKGROUND OF THE INVENTION

Field of the Invention

The present invention is broadly concerned with improved magnetic switch assemblies which overcome the tendency of some prior switches to hang up or stick owing to frictional forces encountered during switch operation. More particularly, the invention is concerned with such switch assemblies having a housing with an elongated electrode extending into the housing and having a free end. The electrode includes an enlarged diameter section adjacent the inner free end of the electrode to prevent switch malfunction.

Description of the Prior Art

Prior art alarm systems use magnetic switches attached to doors and/or windows for detecting unauthorized opening thereof. One common type of magnetic switch is a so-called reed switch. This type of switch is subject to unauthorized manipulation through use of an external magnet. That is, an intruder can use a strong magnet held in proximity to the reed switch to hold the switch closed (or open depending upon the control scheme), and thereby open a supposedly protected door or window without triggering the alarm system.

Magnasphere Corporation of Waukesha, Wis. commercializes a specialized type of magnetic switch giving improved performance and protection against external magnet manipulation. Such switches generally comprise a metallic housing with an internal switch ball shiftable between a first position in contact with a pair of switch electrodes and a second position out of such simultaneous contact. Switches of this type are disclosed in U.S. Pat. Nos. 5,977,873 and 7,291,794. Other prior references include U.S. Pat. Nos. 5,332,992, 5,530,428, 5,673,021, 5,880,659, 6,087,936, 6,506,987, 6,603,378, 6,803,845, 7,023,308, RE39,731, 7,825,801, 7,944,334, 8,228,191, 8,314,698, 8,487,726, and 8,648,720, and EP 2638555. In the absence of sophisticated switch ball conditioning, the switch balls of these switches can hang up or become stuck in the simultaneous electrode contact positions thereof, owing to frictional forces encountered between the balls and electrodes. This is a problem which can detract from the utility of the magnetic ball switches.

SUMMARY OF THE INVENTION

The present invention overcomes the problems outlined above, and provides magnetic switch assemblies which are designed to preclude the problem of hangup or sticking of the shiftable components of the assemblies. Thus, the invention provides switch assemblies having a housing, an elongated first electrode extending into said housing, a second electrode spaced from the first electrode, and a conductive component within the housing shiftable between first and second switch positions depending upon the magnetic field condition acting upon the shiftable component. The first switch position obtains when the shiftable component is in simultaneous contact with the first and second electrodes, whereas the second switch position is established when the component is out of such simultaneous contact. The improved switches of the invention include a first electrode having an elongated, rod-like section of reduced diameter presenting a free end, and an enlarged section of greater diameter proximal to the free end, so that the component in the first switch position simultaneously contacts the enlarged first electrode section and the second electrode.

In preferred forms, the second electrode comprises the housing and the shiftable component is in the form of a substantially spherical ball. In certain embodiments, the component may comprise a permanent magnetic material; in other embodiments, however, the component may comprise a ferromagnetic material (i.e., a material having a susceptibility to magnetization via an applied magnetic field).

Certain switch embodiments are useful as a part of alarm systems or in other environments where it is desired to monitor the positions of the switches (e.g., door or window position monitoring). In such instances, the assemblies each comprise a housing formed of electrically conductive material with an elongated electrically conductive electrode extending into the housing and including a section of reduced diameter with a free end, and an enlarged, electrically conductive section proximal to the free end. Such switches also have a magnetic operating assembly including an electrically conductive component within the housing and shiftable between a first switch position where the component is in simultaneous electrical contact with the enlarged section and the housing, and a second switch position where the component is out of the simultaneous contact. The operating assembly serves to create a magnetic field condition to shift the component to the first switch position when the switch is at one location, and to create a different magnetic field condition to switch said component to the second switch position when the switch is at another location.

Advantageously, the operating assembly comprises a biasing element carried by the housing, and a separate actuating component. The switch is shiftable between a position where the housing is adjacent the actuating component to thus establish a corresponding magnetic field operating on the shiftable component, and another position wherein the housing is remote from the actuating component and a different corresponding magnetic field condition is established. In certain embodiments, the shiftable component is formed of or comprises a (usually permanent) magnetic material, and the biasing element and actuating component each formed of a metallic material. The first electrode has an elongated section of reduced, substantially constant diameter, whereas the enlarged section may be of any desired shape such as frustoconical or circular.

DETAILED DESCRIPTION OF THE PREFERRED EMBODIMENTS

Figure 1:
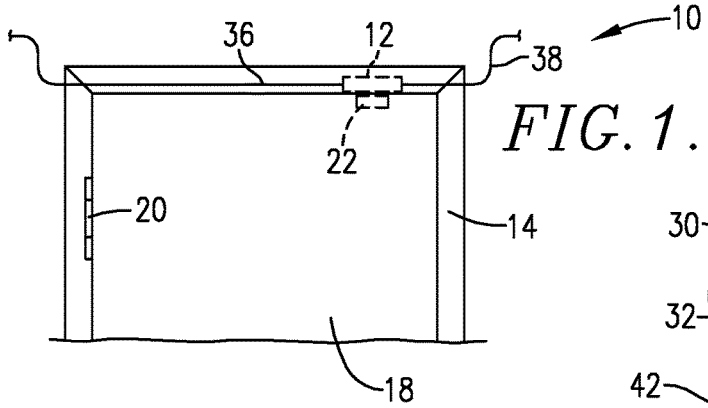
FIG. 1 is an elevational view of a conventional door protected using a magnetic switch in accordance with the invention.

FIG. 1 illustrate a switch assembly 10 including a housing 12 adapted to be mounted within a stationary door frame 14 and having a magnetic switch 16 therein. In this illustration, the assembly 10 is designed to monitor the condition of door 18 within frame 14 via hinges 20. The switch 16 operates in conjunction with an actuating body 22 mounted on door 18, so that when the latter is closed, the body 22 is in direct adjacency with switch 16.

Figure 2:
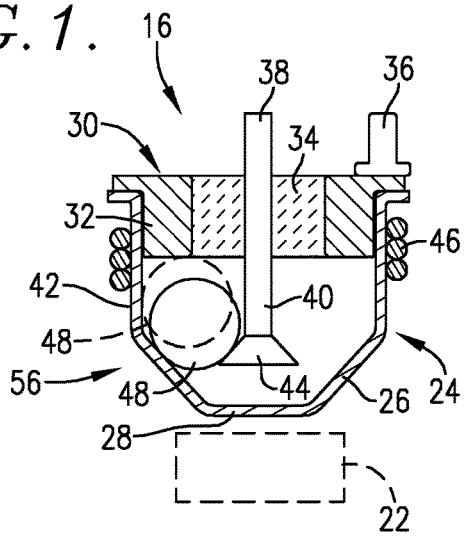
FIG. 2 is an enlarged, vertical sectional view of one magnetic switch in accordance with the invention.

The switch 16 is illustrated in FIG. 2 and has a hollow metallic housing 24 presenting a circular in cross-section converging wall 26 terminating in a lowermost wall 28. A cover 30 is affixed to the upper end of housing 24 and includes an outer, annular, electrically conductive metallic segment 32 and an inner central segment 34 formed of non-conductive material, such as glass, ceramic, or synthetic resin. A pair of electrical leads 36 and 38 are respectively secured to segment 32 and a rod-like electrode extending through the central segment 34. The switch 16 thus has a pair of electrodes electrically coupled with the leads 36, 38, namely the first central electrode 40 and a second electrode 42 spaced from the electrode 40 and comprising the metallic housing 24 itself. As illustrated in FIG. 2, an enlarged, electrically conductive frustoconical section 44 is provided adjacent the lowermost free end of the electrode 40, which is important for reasons to be described.

Figure 2A:
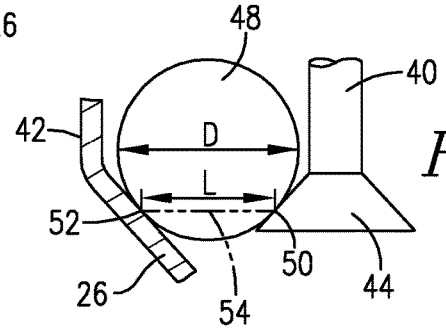
FIG. 2A is a greatly enlarged, fragmentary view illustrating the orientation of the switch ball of the magnetic switch in the first position thereof in simultaneous contact with the switch electrodes, illustrating important dimensional relationships.

The overall switch 16 further includes an annular, multiple-loop biasing ring 46 located about housing 24 adjacent the upper end thereof; in alternate embodiments, a single loop biasing ring may be employed. Also, a shiftable switch component in the form of a spherical switch ball 48 is located within housing 24 and is magnetically shiftable between alternate first and second switch positions, i.e., a first position shown in bold line in FIG. 2, in simultaneous contact with section 44 and converging wall 26, and a second position in phantom out of such simultaneous contact. Referring to FIG. 2A, it will be seen that when the ball 48 is in the first position thereof, the ball contacts section 44 at a point 50, and simultaneously contacts wall section 26 at a point 52. The distance L spanning the distance between ball/housing contact points 50, 52 presents a chord 54, which is less than the diameter D of the ball 48.

The biasing ring 46, ball 48, and actuating body 22 cooperatively provide a magnetic switching assembly broadly referred to by the number 56, which serves to operate switch 16. In preferred forms, the ball 48 is made of a suitable permanent magnetic material (or is coated with such a material), whereas biasing ring 46 and actuating body 22 are made of corresponding magnetic materials which magnetically couple with ball 48, i.e., the materials are capable of attracting the ball 48.

Again referring to FIGS. 1 and 2, where door 18 is in the closed position with actuating body 22 adjacent housing 24, the magnetic coupling and attraction between body 22 and ball 48 causes the latter to assume the first position thereof shown in FIG. 2A, against the bias of ring 46. However, when the door 18 is opened, thereby separating the body 22 and housing 24, the biasing ring 46 comes into play in order to magnetically couple with and shift the ball upwardly to the phantom line position of FIG. 2, wherein the ball 48 is out of the simultaneous contact, and is in contact only with the housing 24 and segment 32. It will be understood though, that the magnetic assembly 56 can be differently constituted. Thus, the ring 46 and body 22 could be formed of magnetic material, whereas the ball 48 comprises metallic material. In this configuration, the switch 16 would operate in the same manner owing to the magnetic coupling and attraction between the ball 48, ring 46, and body 22. Of course, combinations of these configurations are also possible. What is important is that the assembly 56 be designed so as to magnetically move the ball 48 between the first and second positions thereof as a result of changing the position of housing 24 relative to body 22.

The presence of the enlarged section 44 adjacent the bottom or free end of central electrode 40 serves an important function in the invention. That is, because of the fact that the main body of electrode 40 is of reduced diameter relative to the section 44, the ball 48 cannot become frictionally locked or stuck between the electrode 40 and the housing 24. Normally, the length L of chord 54 is less than that of the diameter D of the ball 48, and this serves to prevent locking of the ball 48. Generally speaking, it is preferred that the ratio of the length L of chord 54 relative to diameter D ranges from about 65-96%, more preferably from about 70-94%.

Figure 3:
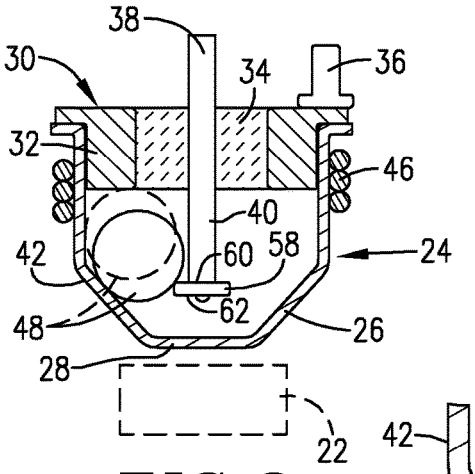
FIG. 3 is a view similar to that of FIG. 2, but depicting another magnetic switch embodiment.

FIG. 3 illustrates another embodiment of the invention, which contains many of the same parts as the FIG. 2 embodiment and these common parts are similarly numbered. The difference in FIG. 3 is that the frustoconical section 44 is replaced by a radially enlarged circular ring or head 58 having opposed, annular surfaces 60 and 62. As illustrated, when ball 48 is in the first position thereof, there is a point contact between the outer end of surface 60 and housing wall 26, much in the same manner as the point contact of FIG. 2A. There is no particular criticality in the shape of the enlargement provided at the end of the electrode 40, so long as it serves to prevent locking of the ball 48 in the first position thereof.

Figure 4:
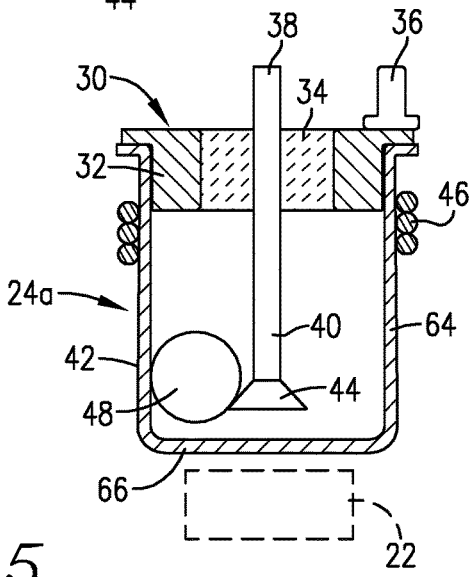
FIG. 4 is a view of similar to that of FIGS. 2 and 3, but illustrating a still further magnetic switch embodiment.

FIG. 4 illustrates a still further embodiment making use of a housing 24*a* different than the housing 24 of FIG. 2. In the FIG. 4 embodiment, the housing 24*a* has a tubular side wall section 64 and an essentially flat bottom section 66. Again, the enlargement 44 serves to create a desirable point contact with ball 48 in the first position thereof.

Figure 5:
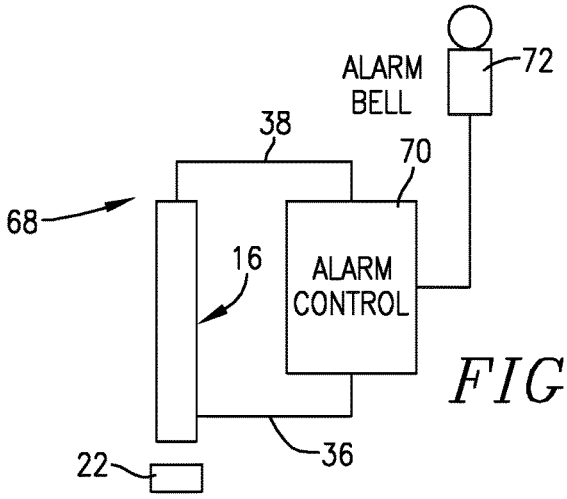
FIG. 5 is a schematic representation depicting the interconnection of magnetic switches in accordance with the invention into an alarm system.

FIG. 5 illustrates a switch 16 in accordance with the invention as a part of an alarm system 68. The switch 16 is coupled via leads 36 and 38 to an alarm controller 70, which operates alarm bell 72 or other perceptible alarm device.

In operation, the system 68 when armed is designed to detect an unauthorized opening of door 18. In the door closed position of FIG. 1, the actuating body 22 is directly adjacent the switch 16 and, as a consequence, the ball 48 is in the first position thereof owing to the magnetic coupling between body 22 and ball 48, shown in bold lines in FIG. 2. Upon opening of the door 18, the switch 16 moves out of proximity to the body 22 to a remote position, so that the biasing ring 46 operates to magnetically couple with and move the ball 48 to the second position thereof, illustrated in phantom. This serves to initiate operation of the device 72, via controller 70. When door 18 is again closed, the situation is reversed and actuating body 22 serves to magnetically move the ball 48 back to the first position.

It will be appreciated that while the switches of the invention have been described in the context of a security system for doors, the invention is not so limited. That is, the switches may be used in security systems for windows or any other openable structures. Moreover, the switches hereof may be used in any environment where a switch condition change is effected by an alteration in the magnetic field condition operating on the ball 48 or other movable component. For example, the switches can be readily adapted for use as proximity sensors. In this environment, the switches would signal the presence of a body, which magnetically couples with the ball 48. Thus, the switches can be located at a selected sensing position and, in the event that a magnetic coupling structure comes into proximity with the switches, a magnetic attraction is effected between structure and the switch ball 48 or other movable component, thereby signaling the presence of the coupling structure.

We claim:

1. A magnetic switch assembly comprising a housing, an elongated first electrode extending into said housing, a second electrode spaced from the first electrode, and a component within said housing shiftable between first and second switch positions depending upon the magnetic condition acting upon said component, said first switch position being when the component is in simultaneous contact with the first and second electrodes, said second switch position being when the component is out of such simultaneous contact, said first electrode having an elongated, upright, rod-like section of reduced diameter presenting a free end and a corresponding upright longitudinal axis, and an enlarged section of greater diameter proximal to said free end having opposed ends, said component, in said first switch position thereof, simultaneously contacting said second electrode and said enlarged section at first and second contact points, said first contact point between the component and said second electrode, said second contact point between the component and said enlarged section, the chord between said first and second contact points being perpendicular to said upright longitudinal axis, with opposed portions of said component extending above and below said chord.

2. The assembly of claim 1, said enlarged section being frustoconical.

3. The assembly of claim 1, said enlarged section being substantially circular.

4. A magnetic switch assembly comprising a housing, an elongated first electrode extending into said housing, a second electrode spaced from the first electrode, and a component within said housing shiftable between first and second switch positions depending upon the magnetic condition acting upon said component, said first switch position being when the component is in simultaneous contact with the first and second electrodes, said second switch position being when the component is out of such simultaneous contact, said first electrode having an elongated, upright, rod-like section of reduced diameter presenting a free end and a corresponding upright longitudinal axis, and an enlarged, frustoconical section of greater diameter proximal to said free end having opposed ends, said component, in said first switch position thereof, simultaneously contacting said second electrode and said enlarged section at first and second contact points, said first contact point between the component and said second electrode, said second contact point between the component and said enlarged section, there being a chord between said first and second contact points, with opposed portions of said component extending above and below said chord.

* * * * *